United States Patent [19]

Perkins

[11] 3,991,292

[45] Nov. 9, 1976

[54] DUAL COMPRESSION PUFFER INTERRUPTER

[75] Inventor: John F. Perkins, Pittsburgh, Pa.

[73] Assignee: Westinghouse Electric Corporation, Pittsburgh, Pa.

[22] Filed: Oct. 10, 1974

[21] Appl. No.: 513,913

[52] U.S. Cl. ..... 200/148 A; 200/150 G

[51] Int. Cl.[2] ..... H01H 33/70

[58] Field of Search ..... 200/148 A, 150 G

[56] References Cited

FOREIGN PATENTS OR APPLICATIONS 671,326 2/1939 Germany ..... 200/148 A 2,025,054 1/1971 Germany ..... 200/148 A

*Primary Examiner*—Robert S. Macon

*Attorney, Agent, or Firm*—R. E. Converse, Jr.

[57] ABSTRACT

A fluid-blast circuit interrupter of the puffer type is provided having two pistons connected in tandem to compress arc-extinguishing fluid in two separate volumes and to produce two separate fluid blasts. Valve action is provided to delay the initiation of the second blast until the interrupter contacts have reached the desired separation distance. By changing component dimensions the degree of compression of arc-extinguishing fluid may be changed without delaying the instant of contact separation.

10 Claims, 4 Drawing Figures

DUAL COMPRESSION PUFFER INTERRUPTER

BACKGROUND OF THE INVENTION

1. Field of the Invention:

This invention relates in general to circuit interrupters and more particularly to fluid-blast circuit interrupters of the puffer type.

2. Description of the Prior Art:

The advantages of using sulfur hexafluoride ($SF_6$) gas in fluid-blast circuit interrupters are well known to those skilled in the art. There are two basic types of fluid-blast circuit interrupters using $SF_6$: two-pressure interrupters and puffer interrupters. The two-pressure interrupter uses a compressor to produce a reservoir of high pressure gas which creates a blast to extinguish the arc established between separating contacts. Since the reservoir may be large and the gas pressure inside it high, this type of breaker is suitable for higher interruption ratings. The puffer interrupter, on the other hand, maintains a relatively low ambient gas pressure inside the interrupter, typically about 60 psi, and produces a gas blast for the purpose of arc extinction by means of a transient compression of gas performed by a piston. The puffer is normally used for lower interruption ratings only. The prime advantage of a puffer interrupter is its lower cost, for it does not require heaters to prevent gas liquification or expensive compressor components which are necessary in a two-pressure breaker. Therefore it would be desirable to use a puffer interrupter in service categories requiring a higher interruption rating.

The size and cost of a circuit interrupter actuating mechanism can be minimized when interrupting capability is limited to the service rating plus a sufficient safety margin. One method for varying the interruption capability requiring few component modifications is to vary the degree of compression to which the arc-extinguishing fluid is subjected prior to initiation of the extinguishing blast. However, varying the degree of compression in previous interrupters has often required a delay in the separation of contacts resulting in a delay in arc establishment. It would be desirable to produce a circuit breaker design suitable for a variety of ratings by varying the degree of compression without delaying the moment of arc initiation.

In U.S. Pat. No. 3,331,935, entitled GAS BLAST CIRCUIT BREAKER HAVING DUAL PISTON MEANS PROVIDING DOUBLE ACTING PUFFER ARRANGEMENT, issued July 18, 1967 to Stanislaw A. Milianowicz and assigned to the assignee of the instant application, there is disclosed a circuit interrupter using two pistons to compress arc-extinguishing fluid within the same volume, thereby producing two blasts of fluid. It would be desirable to produce a circuit interrupter generating two blasts of arc-extinguishing fluid with a simpler mechanism.

SUMMARY OF THE INVENTION

In accordance with a preferred embodiment of the present invention there is provided a fluid-blast circuit interrupter of the puffer type which includes primary and secondary compression means, and primary and secondary pistons cooperable with the compression means to produce two blasts of arc-extinguishing fluid. The degree of fluid compression can be varied without delaying contact separation, allowing a single design to be used in interrupters having a variety of service ratings.

BRIEF DESCRIPTION OF THE DRAWINGS

The invention may be readily understood when considered in view of the following detailed description of exemplary embodiments thereof, taken with the accompanying drawings in which.

Throughout the drawings, like reference characters refer to like members.

DESCRIPTION OF THE PREFERRED EMBODIMENT

Figure 1:
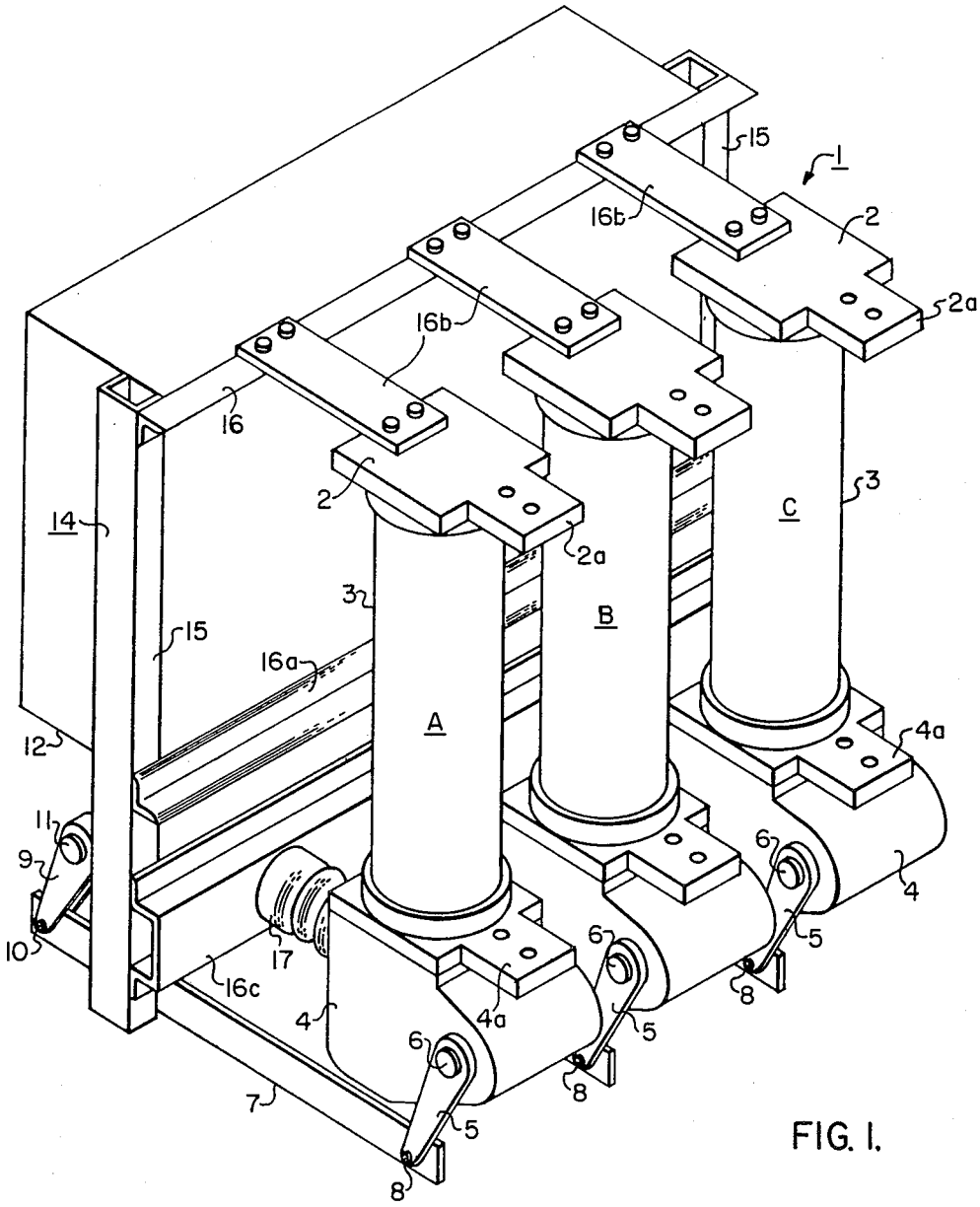
FIG. 1 is a perspective view of a three-pole circuit interrupter embodying the principles of the present invention.

Referring to the drawings, and more particularly to FIG. 1 thereof, reference numeral 1 generally designates a three-pole fluid-blast circuit interrupter comprising three spaced interrupting assemblies A, B and C. As will be apparent from FIG. 1, each interrupting assembly includes a terminal casting 2, a generally upstanding cylindrical housing 3, and a mechanism housing 4. Disposed exteriorly of the mechanism housing 4 is a drive crank 5 affixed to an operating shaft 6. A generally horizontal reciprocally movable insulating operating rod 7 is pivotally secured to the external operating crank 5, as at 8, and is connected to a drive crank 9 through a pivotal connection 10. The three drive cranks 9, only one of which is shown, are affixed to and rotatable with an operating drive shaft 11, which is connected to a suitable mechanism 12, constituting no part of the present invention, and may be of the type set forth in U.S. Pat. No. 3,183,332, issued May 11, 1965 to Russell E. Frink and Paul Olsson, and assigned to the assignee of the present invention.

It will be apparent from FIG. 1 that a suitable supporting grounded framework 14 is utilized comprising vertical channel members 15 with interbracing structural steel members **16, 16*a* having horizontally extending insulating support straps 16*b* secured thereto, which assist in supporting the interrupting assemblies. Additionally, lower insulating supports 17 may be employed extending generally horizontally from a channel support member 16*c*, the latter being affixed to the vertical support channels 15**.

Figure 2:
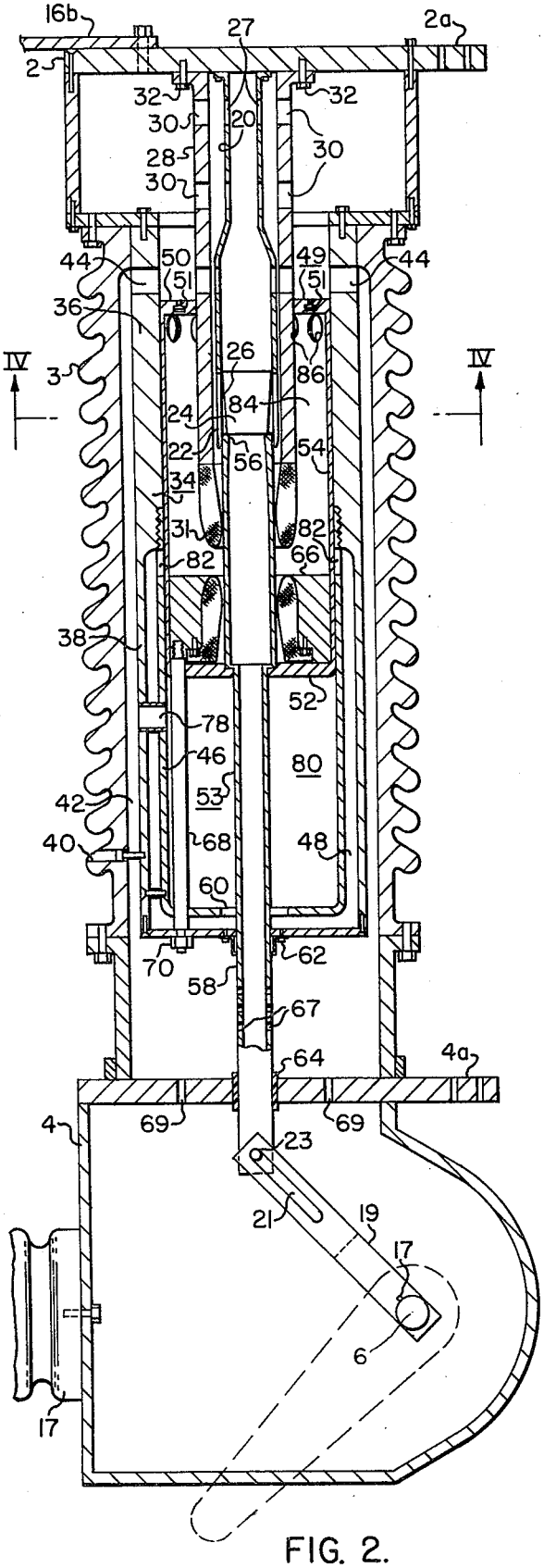
FIG. 2 is a longitudinal sectional view taken through one of the interrupting assemblies of FIG. 1, the interrupting assembly being illustrated in the closed circuit position.
Figure 3:
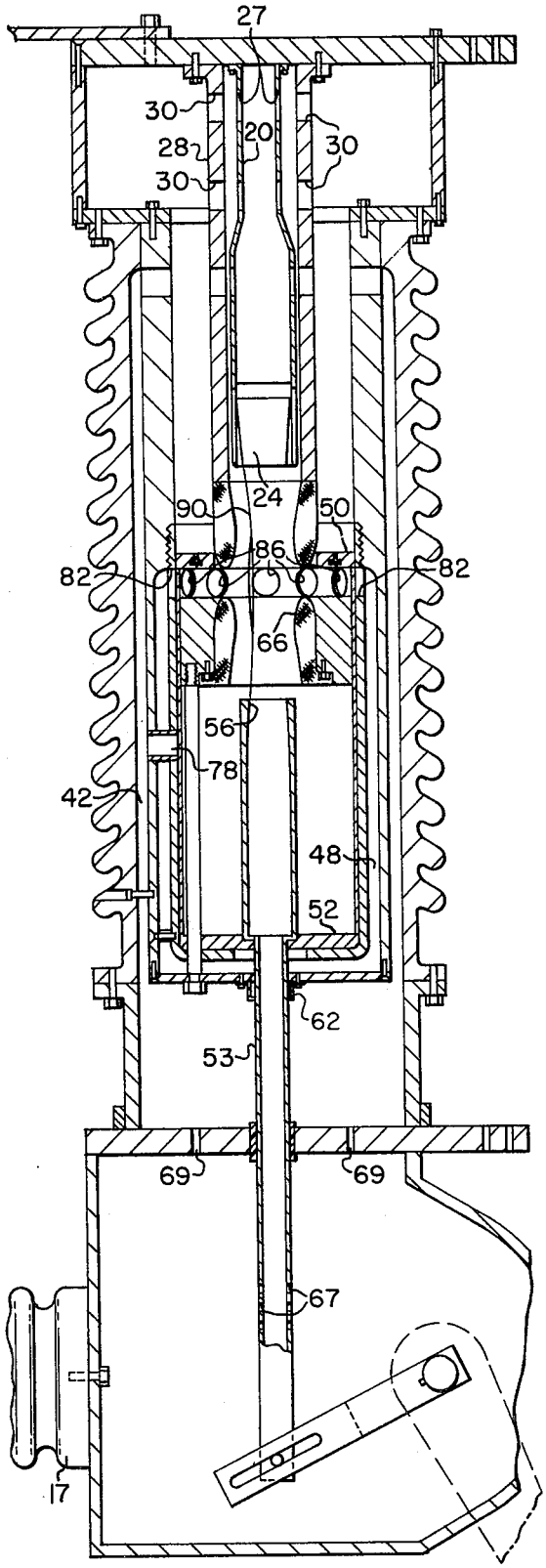
FIG. 3 is a view similar to that of FIG. 2 but illustrating the interrupting assembly in the open circuit position.
Figure 4:
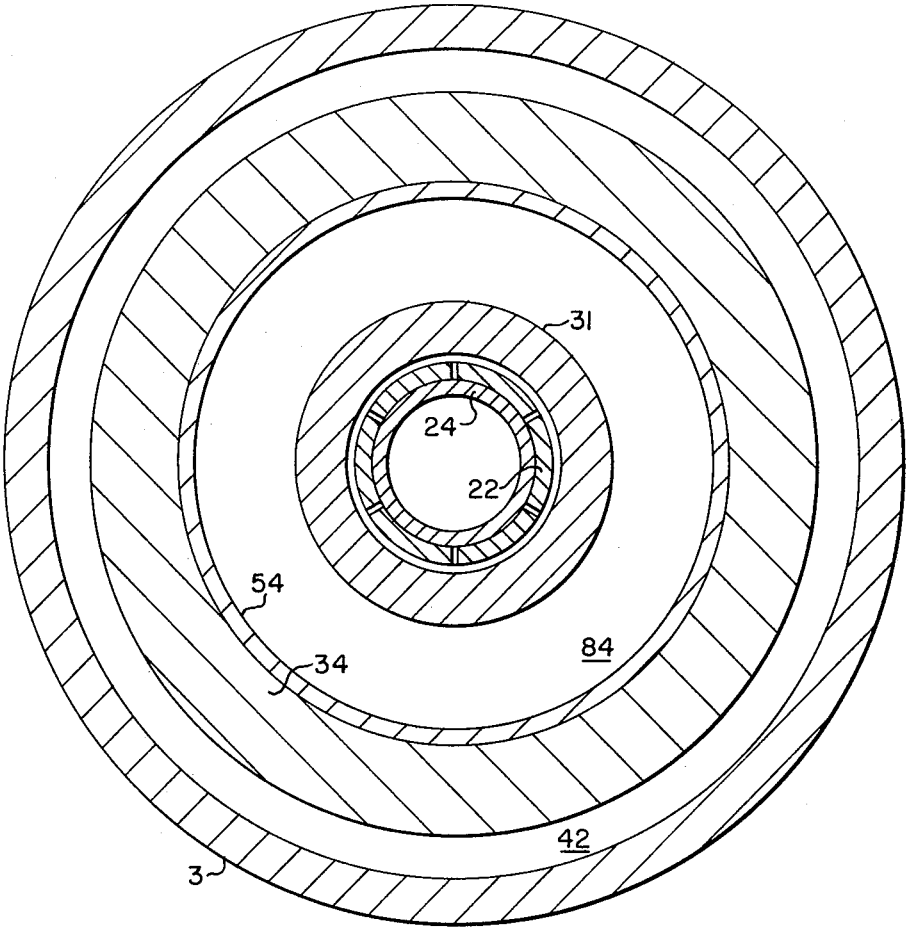
FIG. 4 is a sectional view taken substantially along the line IV—IV of FIG. 2.

FIGS. 2 and 3 more clearly illustrate the internal construction of each of the interrupting assemblies. With reference to FIG. 2 it will be noted that there is provided a cylindrical housing 3 of a suitable insulating material having at one end thereof the terminal casting 2 and included line terminal **2*a* and at the other end the line terminal 4*a* and mechanism housing 4. Attached to the terminal casting 2 and extending into the cylindrical housing 3 is a hollow fixed contact rod 20. This fixed contact rod 20 terminates with a series of fixed flexible fingers 22 formed by slotting the lower end of the fixed contact rod 20. Located concentrically inside the flexible fingers 22** is a metallic orifice contact member 24 of arc-resistant material. This orifice contact member slides upward within the fixed contact rod 20 against the spring 26, forming a lost-motion connection when the contacts close. Contact vents 27 are provided in the upper end of the fixed contact rod 20.

Concentrically surrounding the fixed contact rod 20 and electrically insulated therefrom is a tubular upper nozzle structure 28. This nozzle structure may be made of either metallic or non-metallic material and includes a plurality of exhaust vents 30 and an insualting nozzle mouth 31. The upper nozzle structure is mounted by bolts 32 to the terminal casting 2.

A flow containment cylinder 34 mounted to the terminal casting 2 is disposed coaxially interior to the cylindrical housing 3, surrounding the upper nozzle structure 28. The wall of the flow containment cylinder 34 is of varying thickness, forming an upper portion 36 and a lower portion 38. The upper portion 36 of the flow containment cylinder 34 has a smaller inner diameter than the lower portion 38. A support stud 40 extends across an annular exhaust passage 42 and secures the lower portion 38 of the flow containment cylinder 34 to the interrupting housing 3. The exhaust passage 42 communicates with the interior of the upper portion 36 of the flow containment cylinder through exhaust vents 44. A tubular compression vessel 46 having an open end and a closed end is coaxially disposed within the lower portion 38 of the flow containment cylinder 34. An aperture 60 is centered on the closed end of the compression vessel 46. An outer compression chamber 48 is defined by the radially outer surface of the compression vessel 46 and the radially inner surface of the lower portion 38 of the flow containment cylinder. This outer compression chamber 48 communicates with the interior of the upper portion 38 of the flow containment cylinder through blast vents 82. The inner diameter of the compression vessel 46 is substantially equal to the inner diameter of the upper portion 36 of the flow containment cylinder 34.

A cylindrical piston structure 49 is reciprocally movable within the interior of the upper portion 36 of the flow containment cylinder and the compression vessel 46. The piston structure is composed of an apertured primary piston 50 and an apertured secondary piston 52 connected in tandem by a tubular piston sleeve 54.

The primary piston 50 includes one-way valves 51. The valves 51 prevent gas flow through the primary piston 50 on an opening operation of the interrupter but allow gas flow on a closing operation, providing restoration of gas to the primary compression chamber 84.

A hollow moving contact rod 53 is attached to the secondary piston extending through the piston into the interior of the piston structure 49. The upper portion 56 of the moving rod 53 functions as an arcing contact and is in abutment with the fixed arcing contact rod 20. It is engaged by the steady state contact fingers 22 when the circuit interrupter is in a closed circuit position. The lower portion of the moving contact rod 53 is a connecting rod 58 extending through the aperture 60 at the lower end of the compression vessel 46. The connecting rod 58 also extends through sliding seals 62 in the flow containment cylinder 34, and sliding contact 64 of the lower line terminal 4a. Outlet vents 67 and 69 are provided in the connecting rod 58 and lower line terminal 4a, respectively.

An annular lower nozzle structure 66 is disposed interiorly of the piston sleeve 54 and is rigidly supported as by a support rod 68 extending through apertures provided with gas-tight seals in the secondary piston 52 and the compression vessel 46. The lower nozzle structure 66 is secured as at 70 to the flow containment cylinder 34. The interiors of the upper nozzle mouth 31 and lower nozzle structure 66 and the space between them define an arcing chamber within which an arc is established by separating the contacts 24 and 56, as will be later described.

At the lower end of the cylindrical housing 3 is a mechanism housing 4, through which extends the rotatable operating shaft 6 having affixed thereto, as by a key pin 17, an internally disposed operating crank 19. The end of the crank 19 opposite the shaft 6 is bifurcated, each fork having a slot 21 pivotally engaging a pin 23 of the connecting rod 58 in a lost-motion connection.

The cylindrical housing 3, terminal casting 2, and mechanism housing 4 contain arc-extinguishing fluid, preferably sulfur hexafluoride gas, under a pressure of, for example, 60 psi.

When the circuit interrupter is in a closed circuit position, as in FIG. 2, a gas-restoring vent 78 communicates between the exhaust passage 42 and a secondary compression chamber 80 defined by the inner walls of the compression vessel 46 and the outer surface of the secondary piston 52. Alternatively, one-way valves could be employed in place of the gas-restoring vent 78. Blast vents 82 communicate between the outer compression chamber 48 and a primary compression chamber 84 defined by the inner surfaces of the piston sleeve 54 and primary piston 50, and the lower nozzle structure 66; however, the blast vents 82 are blocked by the piston sleeve 54 when the circuit interrupter is in a closed circuit position. A plurality of inlet apertures 86 are provided in the piston sleeve 54.

During an interruption operation, actuation of the operating mechanism 12 (FIG. 1), causes, through the operating crank 19 and the pin 23, downward compressing action of the connecting rod 58 and the piston structure 49. Downward biasing action of the spring 26 maintains contact between the orifice contact member 24 and the moving contact 56 until the steady-state contact fingers 22 are disengaged and the orifice contact member 24 reaches the limits of its travel. At this time an arc 90 (FIG. 3) is established between the orifice contact member 24 and the moving contact 56. Downward motion of the primary piston 50 causes a compression of $SF_6$ gas in the primary compression chamber 84. The inlet apertures 86 are blocked by the inner wall of the upper portion 36 of the flow containment cylinder 34. A first blast of gas is initiated from the primary compression chamber 84 when the moving contact 56 clears the upper nozzle mouth 31. The gas flows radially inward between the upper nozzle mouth 31 and lower nozzle structure 66, against the arc 90, and axially outward through the interior of the upper nozzle structure 28, the fixed contact rod 20, and moving contact rod 53. Exhaust occurs through the vents 27, 30, 67, and 69.

Downward motion of the secondary piston 52 initially produces a flow of gas through the gas-restoring vent 78; however, continued downward motion causes the piston sleeve 54 to block the gas-restoring vent 78. Since the piston sleeve 54 is already blocking the blast vents 82, continued downward motion of the secondary piston 52 causes a build-up of gas pressure in the secondary compression chamber 80 and the outer compression chamber 48.

As the piston structure 49 moves downward, pressure continues to build within the secondary compression chamber 80 until such time as the inlet apertures 86 become aligned with the blast vents 82, as shown in FIG. 3. The process of aligning the inlet apertures 86 of the piston sleeve 54 with the blast vents 82 constitutes a valve action which initiates a second blast of gas from the secondary compression chamber 80 and the outer compression chamber 48 radially inward between the nozzle structures 28 and 66 against the arc 90, providing an additional gas-blast to assure interruption of the arc. By proper placement and shaping of the inlet apertures 86 through the piston sleeve 54 the blast can be initiated whenever desired, for instance at a time when the moving contact 56 and the orifice contact 24 are at the point of greatest separation. Instead of circular inlet apertures 86 as shown, vertical slot-shaped apertures could be provided, thus providing a long-duration blast initiated earlier in the interruption cycle.

Another important feature of the invention is the ability to vary the degree of compression of the $SF_6$ gas before flow initiation. It is possible to so vary the degree of compression without delaying the instant of contact separation as was the case in some previous designs, thus obtaining great flexibility to produce interrupters for a variety of ratings with a minimum of modifications. For lower service ratings it is possible to produce a puffer interrupter requiring a minimum of actuating force by providing a relative low degree of compression. On the other hand, much higher interruption ratings can be obtained by increasing the degree of compression of the $SF_6$ gas before blast initiation. The degree of compression of $SF_6$ gas in the primary chamber can be increased by lengthening the moving contact rod 53 and the piston sleeve 54 relative to the fixed contact rod 20. For the gas compressed by the secondary piston, one way to increase the compression ratio is to reduce the diameter of the lower portion 38 of the flow containment cylinder 34 relative to that of the compression vessel 46. This has the effect of reducing the volume of the outer compression chamber. For an ambient $SF_6$ pressure of 60 psi the primary piston raises the pressure to about 120 psi, while the secondary piston can produce $SF_6$ pressures between 120 psi and 350 psi.

The ability to achieve a high degree of compression of $SF_6$ gas means that a high interruption rating, previously obtainable only with two-pressure devices, can be obtained with a low ambient gas pressure, for example 60 psi, so that the use of heaters to prevent $SF_6$ liquification is not necessary.

During the closing operation, the operating mechanism 12 effects clockwise rotative closing motion of the drive shaft 6, which through the operating crank 19 and the pin 23 effects upward closing motion of the connecting rod 58 and the piston structure 49. This action continues until the orifice contact member 24 and the movable contact 56 are in abutment with the stationary fingers 22 engaging the moving contacts 56 as in FIG. 2. The $SF_6$ gas returns to its original volume within the secondary compression chamber 80 through the gas-restoring vents 78 and through the interior of the hollow movable contact rod 53.

In an alternative embodiment the diameter of the moving contact 56 is smaller than the diameter of the lower nozzle structure 66, providing communication between the primary compression chamber 84 and the inner surface of the secondary piston 54. Pressure formed during an interruption operation will generate a downward force on the interior surface of the secondary piston. Since the area of this surface is greater than the surface area of the primary piston, the net resultant force tends to aid the desired movement of the piston and counter the tendency toward piston-stalling by arc-generated pressure.

From the foregoing description of the invention it will be apparent that there is provided a puffer interrupter having two compression chambers and producing two blasts of arc-extinguishing fluid resulting in interruption capability which heretofore could only be accomplished using a two-pressure type circuit interrupter. A variety of interruption ratings can be provided by the invention due to the feature of varying the degree of compression without delaying the instant of contact separation.

Although there has been illustrated and described a specific structure it is to be clearly understood that the same is merely for the purpose of illustration and that changes and modifications may be readily made therein by those skilled in the art without departing from the spirit and scope of the invention.

I claim:

1. A puffer interrupter comprising:

a. primary and second compression chambers, b. means for supplying arc-extinguishing fluid to said compression chambers, c. primary and secondary pistons movable in said compression chambers, d. means for moving said pistons, e. nozzle means defining an arcing chamber, f. separable contacts operable to initiate an arc within said arcing chamber, and g. valve means operable by the movement of said pistons to initiate separate flows of arc-extinguishing fluid from said primary and said secondary compression chambers into said arcing chamber.

2. A puffer interrupter as described in claim 1 wherein said primary and secondary pistons are connected in tandem in a unitary structure.

3. A puffer interrupter as claimed in claim 2, wherein said valve means comprises blast vents communicating between said secondary compression chamber and said arcing chamber, and a piston sleeve connecting said primary and said secondary pistons and having a plurality of inlet apertures, said piston sleeve obstructing said blast vents when said interrupter is in a closed circuit position, actuation of said piston moving means aligning said inlet apertures with said blast vents, to initiate a blast of arc-extinguishing fluid.

4. A puffer interrupter as described in claim 3 wherein the location of said inlet apertures through said piston sleeve determines the instant of blast initiation relative to the instant of contact separation, and the axial length of said inlet apertures determines the duration of the blast.

5. A puffer interrupter as claimed in claim 1, wherein at least one of said fluid flows occurs when said contacts are fully separated.

6. A puffer interrupter as claimed in claim 1, wherein said nozzle means comprise an upper nozzle structure and a lower nozzle structure, said contacts include a movable contact rod connected to said primary piston, said movable contact rod being reciprocally movable within said upper and said lower nozzle structure, said movable contact rod making sliding contact with the interior of said upper nozzle structure and said lower nozzle structure, and the compression of arc-extinguishing fluid by said primary piston and action by said valve means produces a blast of arc-extinguishing fluid when said movable contact rod parts contact with said upper nozzle structure.

7. A puffer interrupter as claimed in claim 1, wherein said nozzle means includes an upper nozzle structure and a lower nozzle structure, said contacts include a movable contact rod reciprocally movable within said upper and lower nozzle structures, the outer diameter of said movable contact rod being smaller than the inner diameter of said upper and lower nozzle structures, and the area of said primary piston is less than the area of said secondary piston.

8. A puffer interrupter as claimed in claim 1, wherein said valve means produces delayed initiation of at least one of said fluid flows relative to the establishment of said arc.

9. A puffer interrupter comprising:

a. a housing containing arc-extinguishing fluid, b. a cylinder disposed within said housing, c. a primary compression chamber within said cylinder, d. a primary piston operable to compress arc-extinguishing fluid within said primary compression chamber, e. a secondary compression chamber within said cylinder, f. a secondary piston operable to compress arc-extinguishing fluid within said secondary compression chamber, g. nozzle means defining an arcing chamber, h. a fixed contact, i. a movable contact structure comprising an arcing contact and means connecting said primary and said secondary pistons, said movable contact structure being cooperable with said fixed contact to establish an arc and at the same time driving said pistons to compress arc-extinguishing fluid within said compression chambers, and j. valve means actuated by said movable contact structure operable to initiate separate fluid flow from said primary and secondary compression chambers into said arcing chamber.

10. A puffer interrupter comprising:

a. a housing containing arc-extinguishing fluid, b. a flow containment cylinder disposed within said housing, said cylinder having a first portion and a second portion, said second portion having a larger inner diameter than the inner diameter of said first portion, c. a tubular compression vessel coaxially mounted within said second portion of said flow containment cylinder, said vessel having an open end and an apertured closed end, said vessel having an inner diameter substantially equal to the inner diameter of said first portion of said operating cylinder, the radially outer surface of said compression vessel and the radially inner surface of said second portion of said flow containment cylinder defining an outer compression chamber, d. an apertured lower nozzle structure coaxially supported within said compression vessel defining an annular space between the radially outer surface of said lower nozzle structure and the radially inner surface of said compression vessel, e. blast vents communicating between said outer compression chamber and the interior of said flow containment cylinder, f. a piston structure reciprocally movable within said compression vessel, said piston structure having an apertured primary piston, an apertured secondary piston, and a tubular sleeve connecting said primary and secondary pistons, said sleeve being movable within said annular space between said lower nozzle structure and said compression vessel, said sleeve having a plurality of inlet apertures therethrough, g. a tubular upper nozzle structure coaxially mounted within said tank and extended through said aperture in said primary piston, h. a fixed contact member coaxially mounted within said upper nozzle, and i. a hollow movable contact rod extending through said flow containment cylinder aperture, said aperture in said secondary piston, and said lower nozzle structure; said movable contact rod being attached to said secondary piston and cooperating with said fixed contact rod, movement of said movable contact rod being operable to initiate an arc and produce separate blasts of arc-extinguishing fluid from said primary and secondary pistons.

* * * * *